US010822213B2

(12) United States Patent
Borøy et al.

(10) Patent No.: US 10,822,213 B2
(45) Date of Patent: Nov. 3, 2020

(54) IN-LINE SPOOLING DEVICE FOR COMPENSATING FLEET ANGLE

(71) Applicant: National Oilwell Varco Norway AS, Kristiansand S (NO)

(72) Inventors: Yngvar Borøy, Søgne (NO); Lars-Wichmann Jansen, Kristiansand (NO); Hugo Lacerda, Kristiansand (NO); Thomas Bjørgen, Kristiansand (NO)

(73) Assignee: National Oilwell Varco Norway AS, Kristiansand S (NO)

( * ) Notice: Subject to any disclaimer, the term of this patent is extended or adjusted under 35 U.S.C. 154(b) by 0 days.

(21) Appl. No.: 16/305,525

(22) PCT Filed: May 24, 2017

(86) PCT No.: PCT/NO2017/050132
§ 371 (c)(1),
(2) Date: Nov. 29, 2018

(87) PCT Pub. No.: WO2017/209622
PCT Pub. Date: Dec. 7, 2017

(65) Prior Publication Data

US 2020/0156907 A1 May 21, 2020

(30) Foreign Application Priority Data

Jun. 2, 2016 (EP) ..... 16172667

(51) Int. Cl.
*B66D 1/38* (2006.01)
*B66C 23/52* (2006.01)

(52) U.S. Cl.
CPC ..... *B66D 1/38* (2013.01); *B66C 23/52* (2013.01)

(58) Field of Classification Search
CPC ... B66D 1/36; B66D 1/38; B66D 1/39; B66D 1/50; B66D 3/26; B66D 2700/0191
See application file for complete search history.

(56) References Cited

U.S. PATENT DOCUMENTS 2,228,346 A * 1/1941 Downie ..... E21B 1/02 242/157.1
2,249,117 A * 7/1941 Crandall ..... B66D 1/38 242/157.1

(Continued)

FOREIGN PATENT DOCUMENTS

AT 346029 10/1978
CA 692070 8/1964

(Continued)

OTHER PUBLICATIONS

Written Opinion for PCT/NO2017/050132 dated Jul. 30, 2017 (4 pages).

(Continued)

*Primary Examiner* — Emmanuel M Marcelo
(74) *Attorney, Agent, or Firm* — Conley Rose, P.C.

(57) ABSTRACT

A spooling device for facilitating spooling of a wire on a drum winch from a feeding point includes a suspension cradle mounted to the mechanical frame. The suspension cradle supports a rotatable wire sheave or receiving the wire extending form the feeding point and for guiding the wire to a specific location on the drum winch. The suspension cradle having the wire sheave is slideably mounted to the frame in accordance with a curved path. The curved path is configured such that the fleet angle of the wire extending from the feed point is at least partially compensated in order to reduce fringing effects of the wire on the wire sheave during sliding movement of the wire sheave along its curved path.

18 Claims, 9 Drawing Sheets

(56) References Cited

U.S. PATENT DOCUMENTS

| | | | | | |
|---|---|---|---|---|---|
| 2,473,628 | A * | 6/1949 | Allison | B66D 1/36 | 242/157.1 |
| 3,078,060 | A * | 2/1963 | Bus, Sr. | B66D 1/36 | 242/157.1 |
| 3,687,385 | A * | 8/1972 | Skalleberg | B65H 54/2803 | 242/470 |
| 3,804,350 | A * | 4/1974 | Williams | B65H 75/4402 | 242/157.1 |
| 4,015,798 | A * | 4/1977 | Benya | B66D 1/38 | 242/157.1 |
| 4,515,329 | A * | 5/1985 | Sandvik | B66D 1/38 | 242/157.1 |
| 4,778,121 | A * | 10/1988 | Minnee | B66D 1/38 | 242/157.1 |
| 4,892,262 | A * | 1/1990 | Hurst | B66D 1/38 | 242/157.1 |
| 5,002,238 | A * | 3/1991 | Inhofer | B66D 1/36 | 242/156.1 |
| 5,281,787 | A * | 1/1994 | Arakawa | B23H 7/10 | 219/69.12 |
| 9,248,999 | B2 * | 2/2016 | Xydias | B66D 1/38 | |
| 2005/0087644 | A1 * | 4/2005 | Kim | B65H 75/425 | 242/390.8 |
| 2016/0016766 | A1 | 1/2016 | Ho | | |
| 2017/0088388 | A1 * | 3/2017 | Lillich | B65H 54/2827 | |

FOREIGN PATENT DOCUMENTS

| | | |
|---|---|---|
| EP | 1726559 | 11/2006 |
| FR | 2185583 | 1/1974 |
| JP | H08301580 | 11/1996 |
| WO | WO2012040777 | 4/2012 |
| WO | WO2014025253 | 2/2014 |

OTHER PUBLICATIONS

International Search Report for PCT/NO2017/050132 dated Jun. 30, 2016 (2 pages).

European Search Report for EP 16172667 dated Nov. 21, 2016 (3 pages).

* cited by examiner

IN-LINE SPOOLING DEVICE FOR COMPENSATING FLEET ANGLE

CROSS REFERENCE TO RELATED APPLICATIONS

This application is a 35 U.S.C. § 371 national stage application of PCT/NO2017/050132 filed May 24, 2017 and entitled "In-line Spooling Device for Compensating Fleet Angle", which claims priority to European Patent Application No. 16172667.4 filed Jun. 2, 2016, each of which is incorporated herein by reference in their entirety for all purposes.

STATEMENT REGARDING FEDERALLY SPONSORED RESEARCH OR DEVELOPMENT

Not applicable.

FIELD OF THE INVENTION

The invention relates to a spooling device for facilitating spooling of a wire on a drum winch from a feeding point. The invention also relates to a crane assembly comprising such spooling device and to a vessel comprising such crane.

BACKGROUND OF THE INVENTION

There are many application fields where drum winches are to be spooled and unspooled in order to effect a translation of a certain object. Examples of such application fields are hoisting applications using cranes both on-shore and offshore, i.e. in the petrochemical industry and maritime industry. A general problem with winch systems is that for an efficient spooling, a spooling device or system is needed to facilitate the feeding of the respective wire or cable in a controlled manner. Expressed differently, the spooling device or system has to ensure that the wire or cable is fed in a reciprocating manner, such that the wire or cable properly builds up a neat stack on the drum winch. The spooling device is typically provided close to the drum winch in the path of the wire or cable being spooled on the drum winch.

A known problem, which the spooling device has to overcome or tolerate is that the wire or cable is typically fed from one point, which in combination with the reciprocating movement of the spooling device, results in a variable fleet angle of the cable that is fed to the spooling device. Fleet angle is a term, which is well-known in the technical field of drum winches. The spooling device typically comprises a sheave, which on one side receives the wire, or cable from the feeding point and on another side feeds the wire or cable to the drum winch, wherein the sheave is translated or pivoted to form the reciprocating movement.

In the prior art different solutions have been reported, which tackle the fleet angle problem.

EP2,933,220A1 discloses a fleet angle tolerant sheave including a body portion with a circular circumference and defining a center plane, a bore extending through the body portion and configured for receiving a shaft and allowing the body portion to rotate in the center plane. The sheave further comprises a rope groove arranged on the circular circumference including a radiused bottom with a first end and a second end and a pair of opposing sidewalls, each extending directly and tangentially from one of the first and second end and having a curved profile.

U.S. Pat. No. 3,589,642 discloses an apparatus for use in controlling the fleet angle of a cable being spooled onto a drum. The apparatus includes first and second sheaves for routing the cable to the drum, said sheaves being mounted for pivotal movement about a pivot axis, which is perpendicular to a plane containing the rotation axis of the drum. The apparatus further includes means for mounting said sheaves in such a manner that forces due to cable tension causes at least one of said sheaves and said pivot axis to lie in a common plane and the elevation of said one sheave with respect to said pivot axis to the determined fleet angle of the cable with respect to the drum.

U.S. Pat. No. 4,015,798 discloses a pivoted frame assembly, which is guided back and forth across a drum winch by an interconnected double diamond lead screw. Sheaves journaled on a frame assembly feed the cable or a hydrophone array in a manner so as not to create crushing stresses on the cable or side load forces during deployment and retrieval. Because of the physical disposition of the framework and sheaves with respect to the drum winch and their mechanical coaction with other related structural elements, the fleeting sheave is closer than contemporary units so that the overall structure is more compact.

From the discussion above, the current prior art solutions focus on creating either fleet angle tolerance or minimizing the fleet angle in spooling systems.

SUMMARY OF THE DISCLOSURE

The present disclosure has for its object to remedy or to reduce at least one of the drawbacks of the prior art, or at least provide a useful alternative to prior art.

The object is achieved through features, which are specified in the description below and in the claims that follow.

In a first aspect, this disclosure relates to as spooling device for facilitating spooling of a wire on a drum winch from a feeding point. The spooling device comprises: a frame and a suspension cradle mounted to the frame, wherein the suspension cradle comprises a rotatable wire sheave for receiving the wire and for guiding the wire to a specific location on the drum winch. The suspension cradle with the wire sheave is mounted in a slideable manner to the frame in accordance with a curved path, wherein the curved path is chosen such that a fleet angle of the wire coming from the feeding point is at least partially compensated in order to reduce fringing effects of the wire on the wire sheave during sliding movement of the wire sheave in operational use of the spooling device.

The effects of such a spooling device are as follows. First of all, the suspension cradle with the wire sheave is mounted in a slideable manner to the frame (for which many implementations are possible) in accordance with a curved path. In addition, this curved path is chosen such that the fleet angle of the wire coming from the feeding point is at least partially compensated for to reduce fringing effects of the wire on the wire sheave during sliding movement of the wire sheave. This partial compensation of the fleet angle means that the angle between the wire and the curved path is kept close to 90 degrees, i.e. the curved path is chosen such that the wire that runs from the feeding point stays substantially perpendicular to the curved path independent of the fleet angle. Another way of saying this is that the wire sheave is kept more in plane with the wire during the reciprocating movement of the suspension cradle.

Essential to the disclosure is that the wire sheave is mounted in a slideable manner. This is in huge contrast with prior art solutions, which may use a wire sheave that is mounted on a pivotable arm. The advantage of the solution of the current disclosure over that solution is huge, particularly when the feeding point is located further away from the spooling device. In case of a large distance between the feeding point and the spooling device, the pivotable arm or prior devices also needs to be very long (or very complex structures are needed). In the spooling device in accordance with the current disclosure such pivotable arm is completely dispensed with, rendering the solution much more compact and less complex.

For proper understanding of the disclosure the term "feeding point" needs some definition. As used herein, the "feeding point" is the place where the wire is fed from when running to and from the spooling device (and eventually the drum winch). In practice, this coincides with a location along the circumference of a sheave. Even though it is called a "point" this does not mean that it is literally a fixed point in space. In case a sheave is used to feed the wire, this point effectively moves along the circumference of the sheave when the fleet angle changes.

In an embodiment of the spooling device in accordance with the disclosure, the curved path is defined such that the fleet angle is substantially compensated along the full swing of the wire sheave in that the wire remains substantially in plane with the wire sheave during the sliding movement of the wire sheave in operational use of the spooling device. This embodiment further improves the disclosed spooling device by ensuring substantial complete compensation for the fleet angle along the full swing of the suspension cradle and sheave.

In an embodiment of the spooling device in accordance with the disclosure, the curved path is, along a full swing of the wire sheave, a substantially circular path having its center coinciding with the feeding point in operational use of the spooling device. This embodiment forms a convenient manner of compensating for the fleet angle over the full swing. In an alternative embodiment, the curved path may be adapted a bit in order to compensate for the non-static behavior of the feeding point.

In an embodiment of the spooling device in accordance with the disclosure, the suspension cradle is mounted to the frame via a first thrust beam, wherein the first thrust beam comprises a curved rail onto which the suspension cradle is mounted in the slideable manner. The provision of a thrust beam having a curved rail forms a very convenient implementation for ensuring the chosen curved path for compensating the fleet angle.

In an embodiment of the spooling device in accordance with the disclosure, the suspension cradle is further mounted to the frame via a second thrust beam displaced from the first thrust beam, wherein the second thrust beam comprises a second curved rail onto which the suspension cradle is mounted in the slideable manner. The provision of a second thrust beam provides for a mechanical more stable construction. Both thrust beams have to be configured and placed such that they both facilitate the movement of the suspension cradle in accordance with the chosen curved path.

An embodiment of the spooling device in accordance with the disclosure further comprises a powered drive mechanism, such as a hydraulic cylinder, mounted to the frame, the powered drive mechanism being coupled to the suspension cradle for actuating the suspension cradle for controlling a position of the suspension cradle on said rail or rails. The suspension cradle is conveniently actuated by means of the powered drive mechanism in this embodiment.

In a second aspect, the disclosure relates to a crane assembly comprising a crane and a drum winch for cooperating with the crane. The crane assembly further comprises an embodiment of the disclosed spooling device. The spooling device is placed between the crane and the drum winch for facilitating the spooling of the wire on the drum winch. This embodiment forms an important application of the disclosure.

In a third aspect, the disclosure relates to a vessel comprising the crane assembly in accordance with the disclosure. The crane assembly in accordance with the disclosure may be conveniently placed on a floating vessel or a rig.

In an exemplary embodiment of the vessel, the crane is placed on a deck of the vessel, wherein the drum winch is placed under the deck, and wherein the spooling device is placed under the deck. This embodiment ensures a convenient placement of the respective parts on the vessel.

BRIEF INTRODUCTION OF THE DRAWINGS

In the following is described an example of an embodiment illustrated in the accompanying drawings, wherein:

FIG. 1 discloses an embodiment of a crane assembly in accordance with the disclosure;

FIG. 2 discloses an embodiment of the spooling device in accordance with the disclosure;

DETAILED DESCRIPTION OF THE DISCLOSED EXEMPLARY EMBODIMENTS

The following description one embodiment of the spooling device will be discussed and particularly concerning its application to a crane on vessel. However, the disclosure is not limited to these examples and may be applied in any winch application, which makes use of a spooling device.

Figure 1:
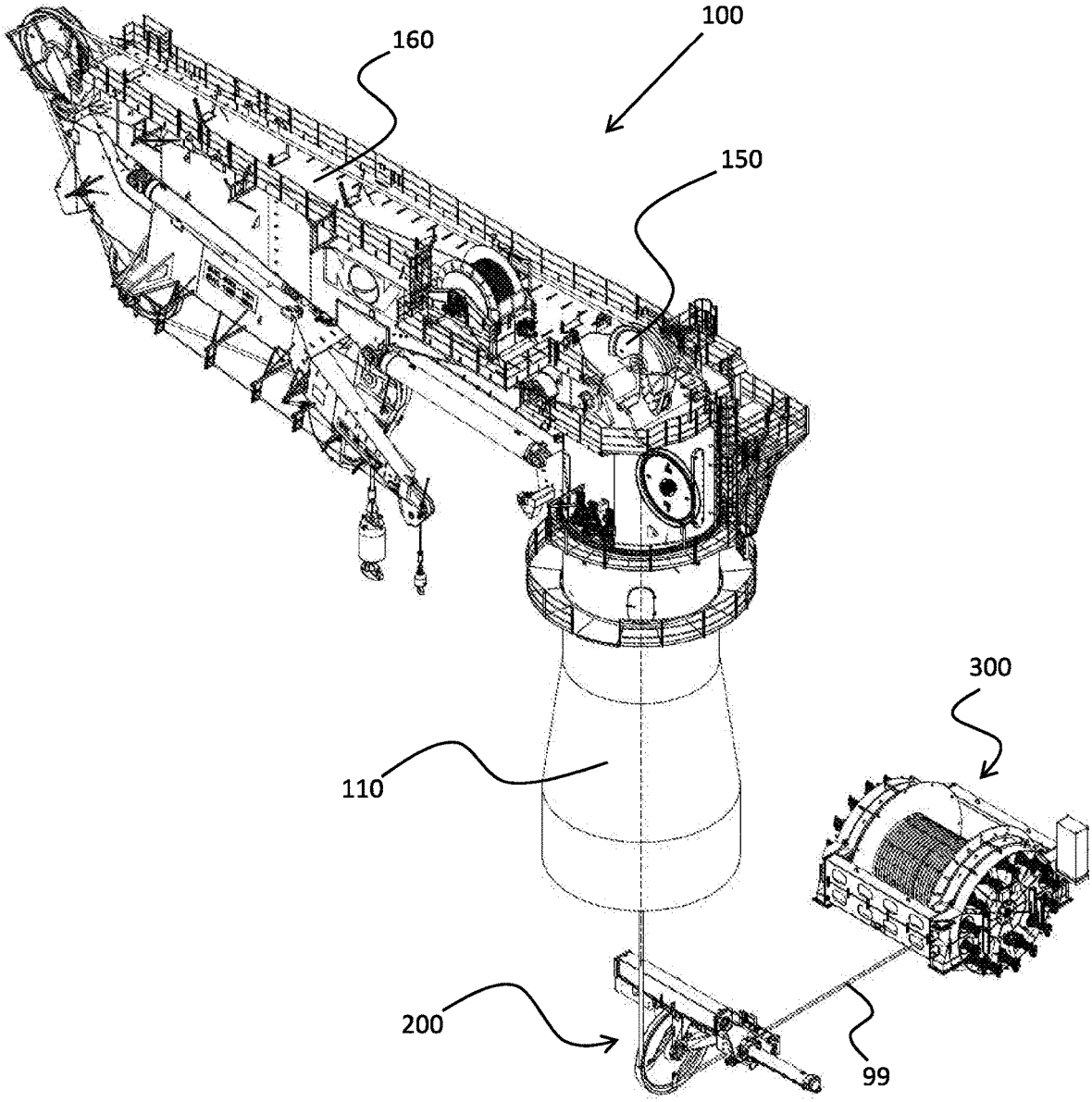

FIG. 1 discloses an embodiment of a crane assembly. The crane assembly is for use on a vessel (not shown). The crane assembly comprises a crane 100, a spooling device 200 and a drum winch 300 as shown. This embodiment of the crane 100 comprises a crane pedestal 110 with a knuckle boom crane 160 as shown, but the disclosure applies to virtually any type of crane. A wire 99 runs from a crane king sheave 150 on the crane 100 down to the spooling device 200 and then then to drum winch 300. The spooling device 200 in accordance with the disclosure is particularly advantageous when the crane pedestal 110 is long, i.e. when there is a large distance between the crane king sheave 150 and the spooling device 200. The spooling device 200 may be located below a vessel's main deck, mounted in front of the drum winch 300 and centered in the crane pedestal 110.

Figure 2:
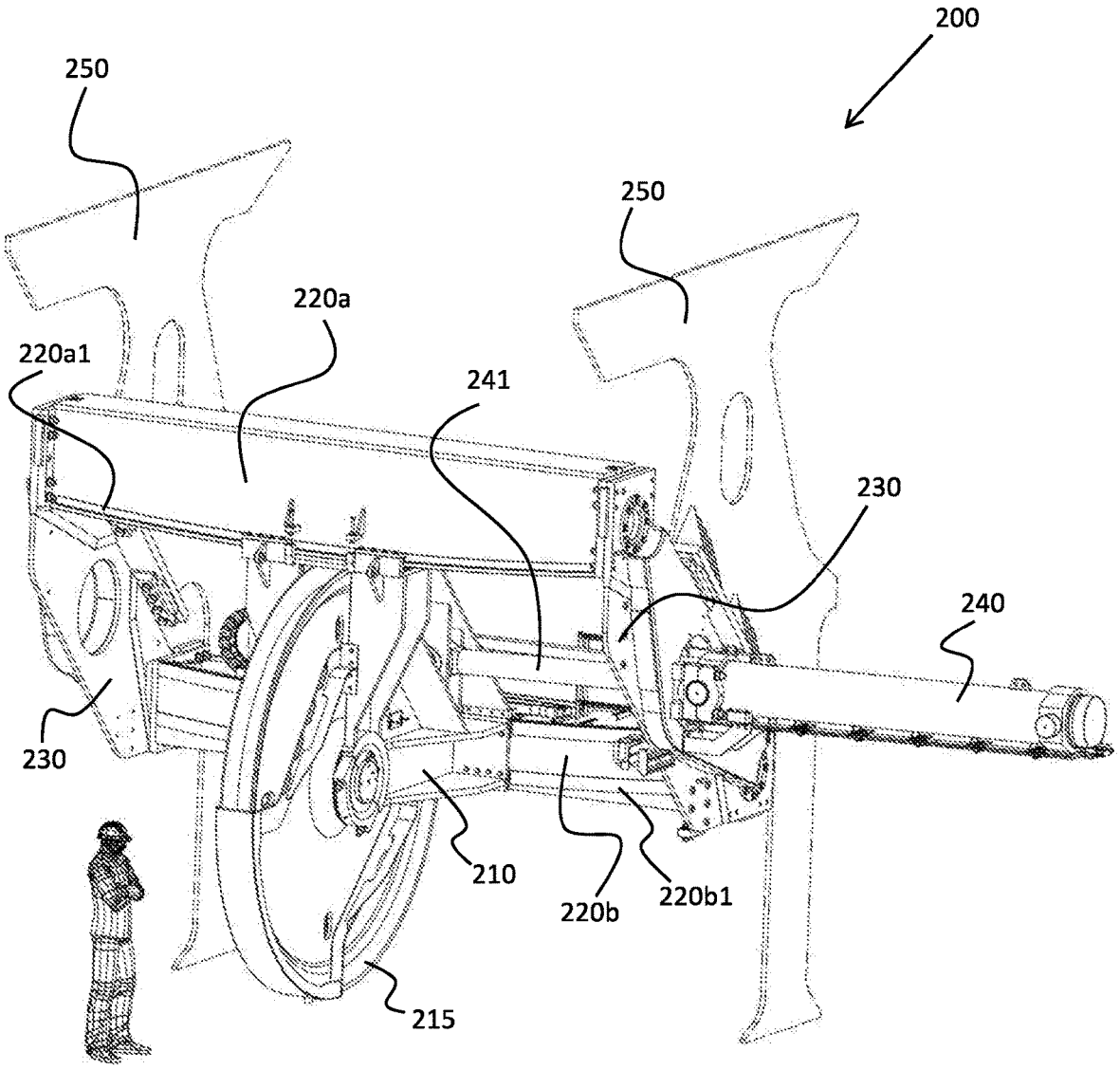

FIG. 2 discloses an embodiment of the spooling device 200 in accordance with the disclosure. As shown in FIG. 2, the spooling device 200 comprises a guide frame 230 mounted in a hull foundation 250 coupled to the deck of the vessel (not shown). In the guide frame 230 comprises a first (curved) thrust beam 220*a* and a second (curved) thrust beam 220*b* as shown. On these thrust beams 220*a*, 220*b* there is slideably mounted a suspension cradle 210 with a wire sheave 215. The suspension cradle 210 is actuated by a powered drive mechanism (here it is a hydraulic cylinder, but it could be many other types of actuators) 240. The hydraulic cylinder 240 comprises a piston rod 241 that is connected to the suspension cradle 210. To facilitate the sliding of the suspension cradle 210 over the thrust beams 220*a*, 220*b*, each of said thrust beams 220*a*, 220*b* is formed with a rail 220*a*1, 220*b*1, which cooperates with the suspension cradle 210. Said rails 220*a*1, 220*b*1 are curved to facilitate the moving of the suspension cradle 210 in accordance with a curved path as will be further explained with reference to other figures.

Figure 3:
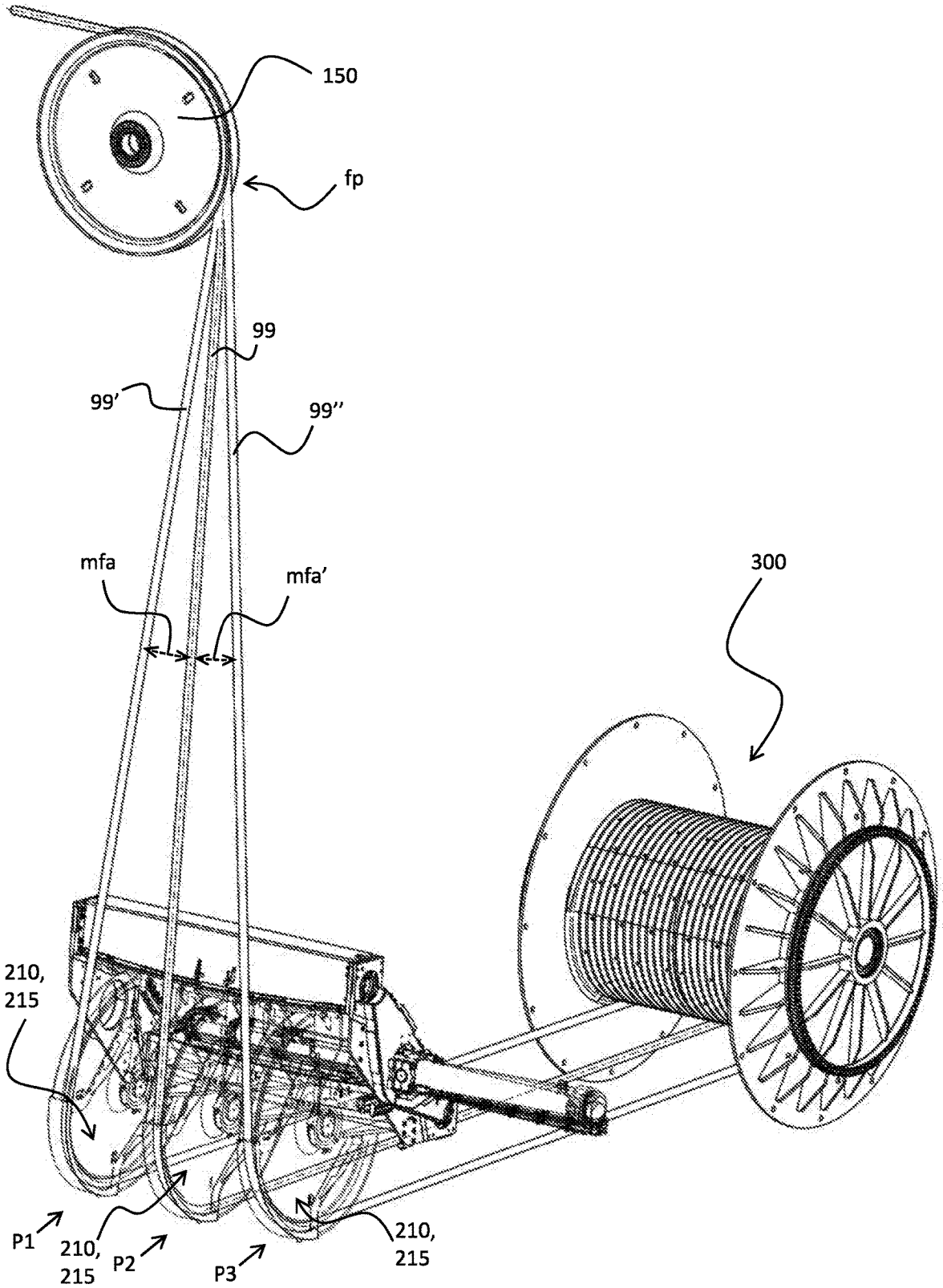
FIG. 3 illustrates the operation of the spooling device of FIG. 2 in a perspective view.

FIG. 3 illustrates the operation of the spooling device of FIG. 2 in a perspective view. In this drawing, three different positions of the suspension cradle are shown. The wire 99 has also been drawn for each of these three positions. The wire 99, 99', 99" runs from the crane king sheave 150 towards the spooling device. When the suspension cradle 210 is moved from left to right along its rails, the wire 99, 99', 99" effectively "pivots" around a feeding point fp as illustrated. The fleet angle is defined with regards to the vertical position of the wire 99, 99', 99" and thus varies between a first maximum fleet angle mfa and a second maximum fleet angle mfa' as illustrated. Thus, there is a center position P2 of the wire 99, wherein the fleet angle is zero, i.e. where the suspension cradle 210 and wire sheave 215 is located right underneath the feeding point fp as illustrated. Then there is the first extreme position P1 of the suspension cradle 210, wherein the wire is indicated with reference numeral 99'. Finally, there is the second extreme position P3 of the suspension cradle 210, wherein the wire is indicated with reference numeral 99".

Figure 4:
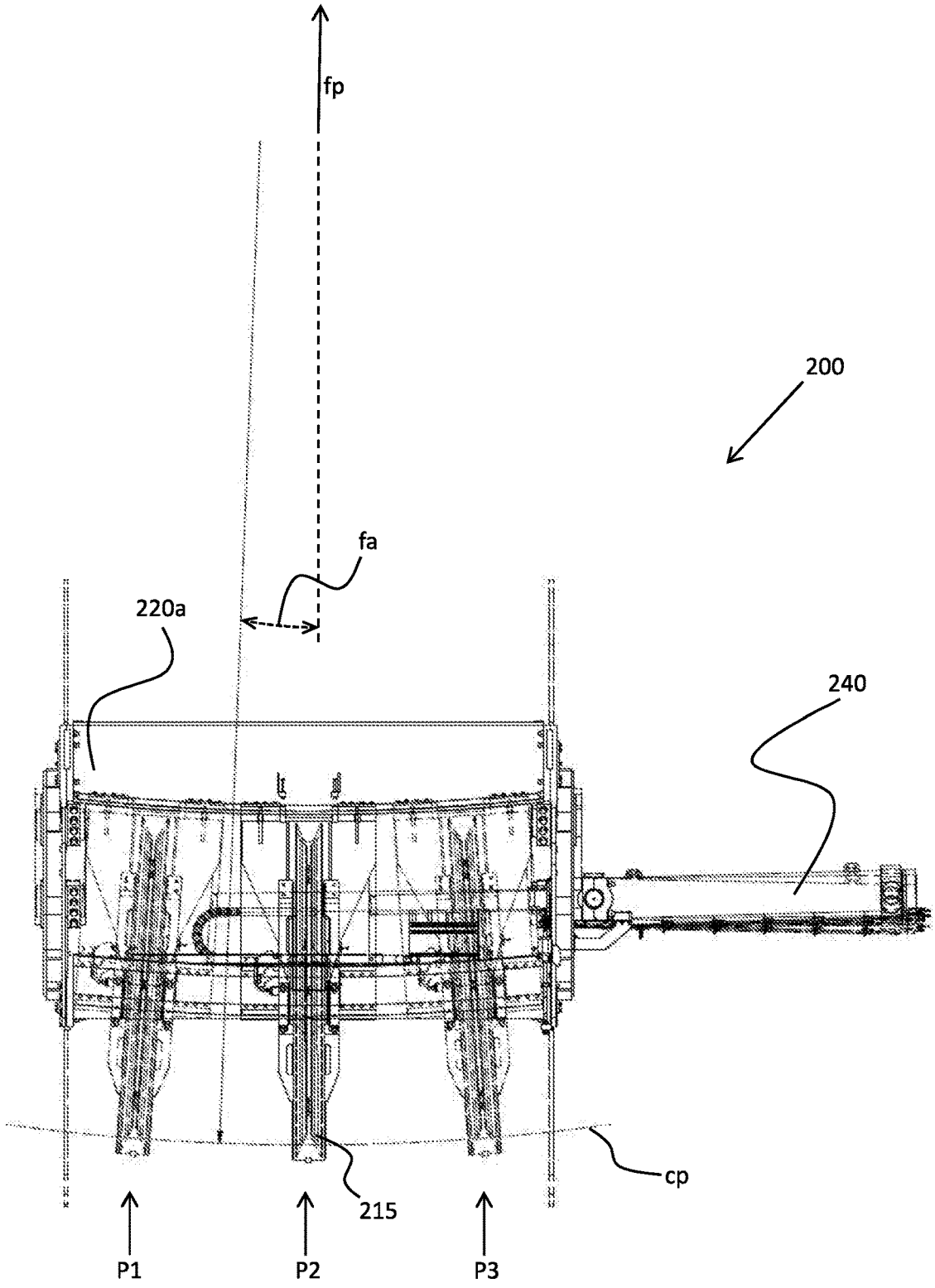
FIG. 4 illustrates the operation of the spooling device of FIG. 2, but as seen from a different perspective.

FIG. 4 illustrates the operation of the spooling device of FIG. 2, but as seen from a different perspective. This figure serves to illustrate the curved path cp. It can be observed from the figure that the curved path cp follows a circle with its center located at the feeding point fp. It is also shown in the figure that the wire crosses this curved path cp perpendicularly independent of the fleet angle fa. The spooling device 200 together with the drum winch 300 ensures a precise spooling of the wire on the drum winch 300 and results in minimum wear of the wire 99 and said sheaves 150 (FIG. 1), 215 and gives no (or negligible) side forces on the wire sheave 215 due to curved guidance of the wire sheave 215. There will be no (or a negligible) fleet angle between the wire 99 coming off the drum winch 300 and the point at which it meets the wire sheave 215 of the spooling device 200. In addition, there will be no (or a negligible) fleet angle between the wire 99 coming off the feeding point fp and to the wire sheave 215 (FIG. 1).

Figure 5:
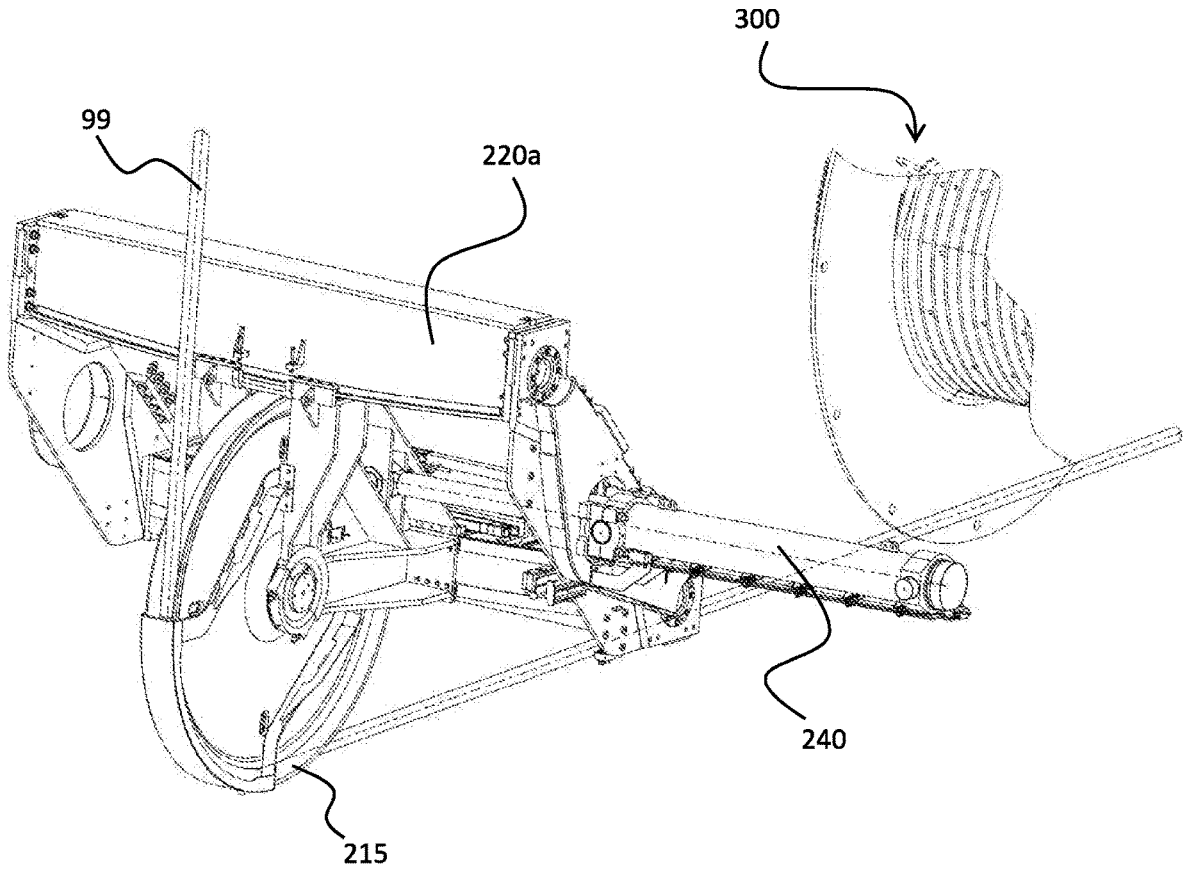
FIG. 5 illustrates some other details of the spooling device of FIG. 2 in operational use.
Figure 6:
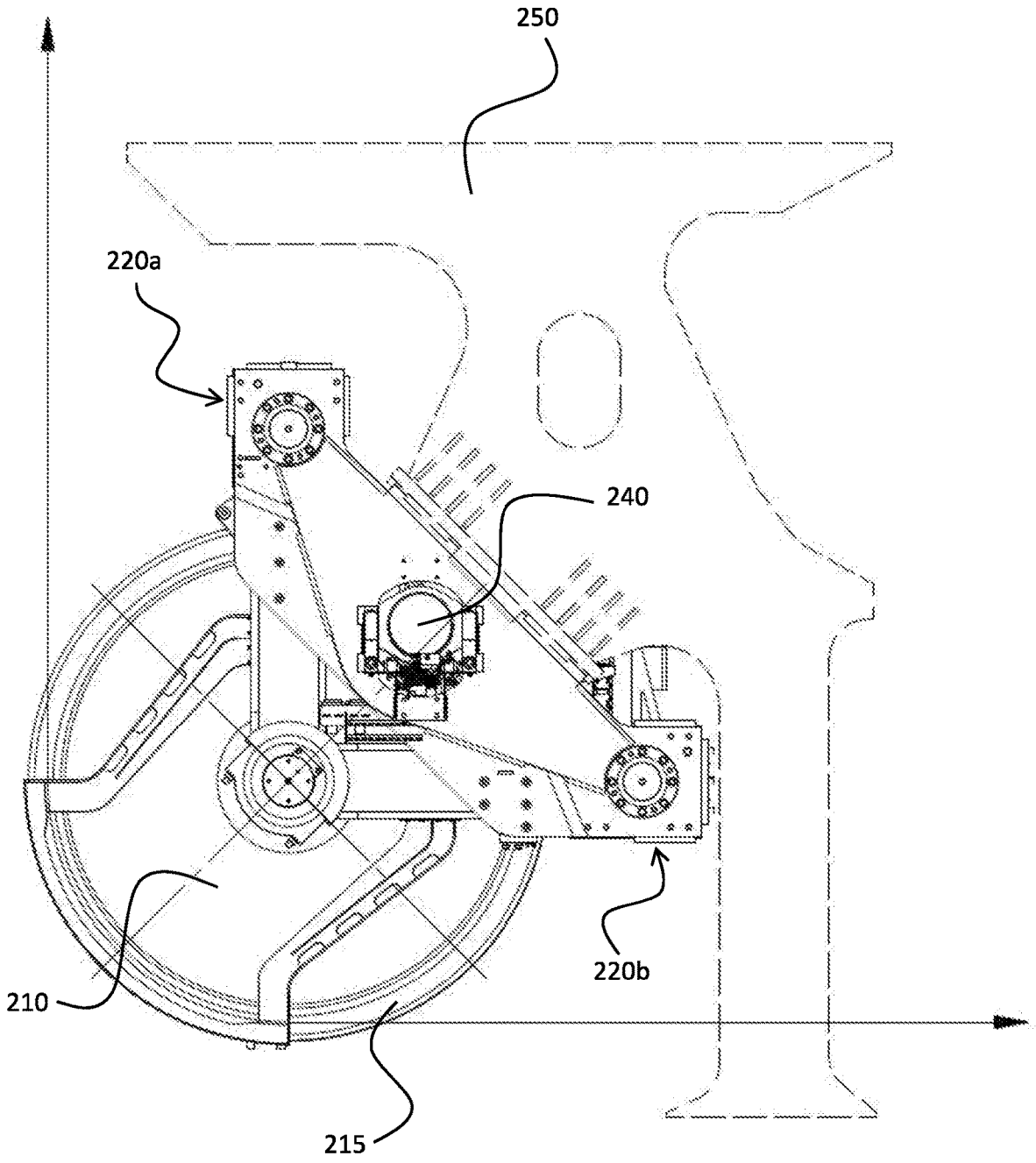
FIG. 6 illustrates yet some other details of the spooling device of FIG. 2 in a side view, and FIG. 7 illustrate the spooling device of FIG. 2 in a center position.

FIG. 5 illustrates some other details of the spooling device of FIG. 2 in operational use. FIG. 6 illustrates yet some other details of the spooling device of FIG. 2 in a side view. In operational use of the spooling device 200, the resultant force from the wire 99 will be distributed via the wire sheave 215, the suspension cradle 210, the thrust beams 220*a*, 220*b*, the guide frame 230 to the hull foundation 250. The side force from the hydraulic cylinder 240 will not cause any tilting force on the suspension cradle 210 due to in-line position of the hydraulic cylinder 240 with the thrust beams sliding faces (no-lever arm). FIG. 6 illustrates this best.

Figure 7:
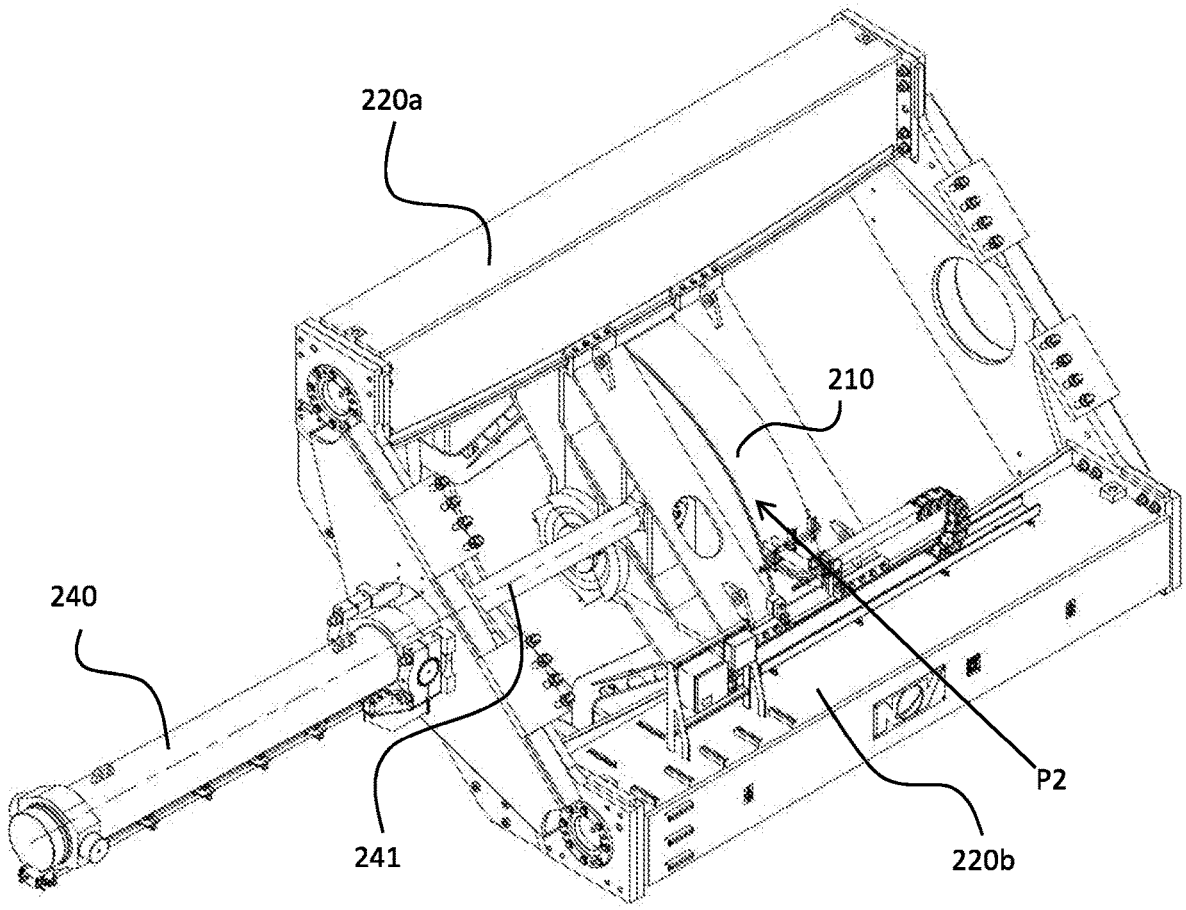
Figure 8:
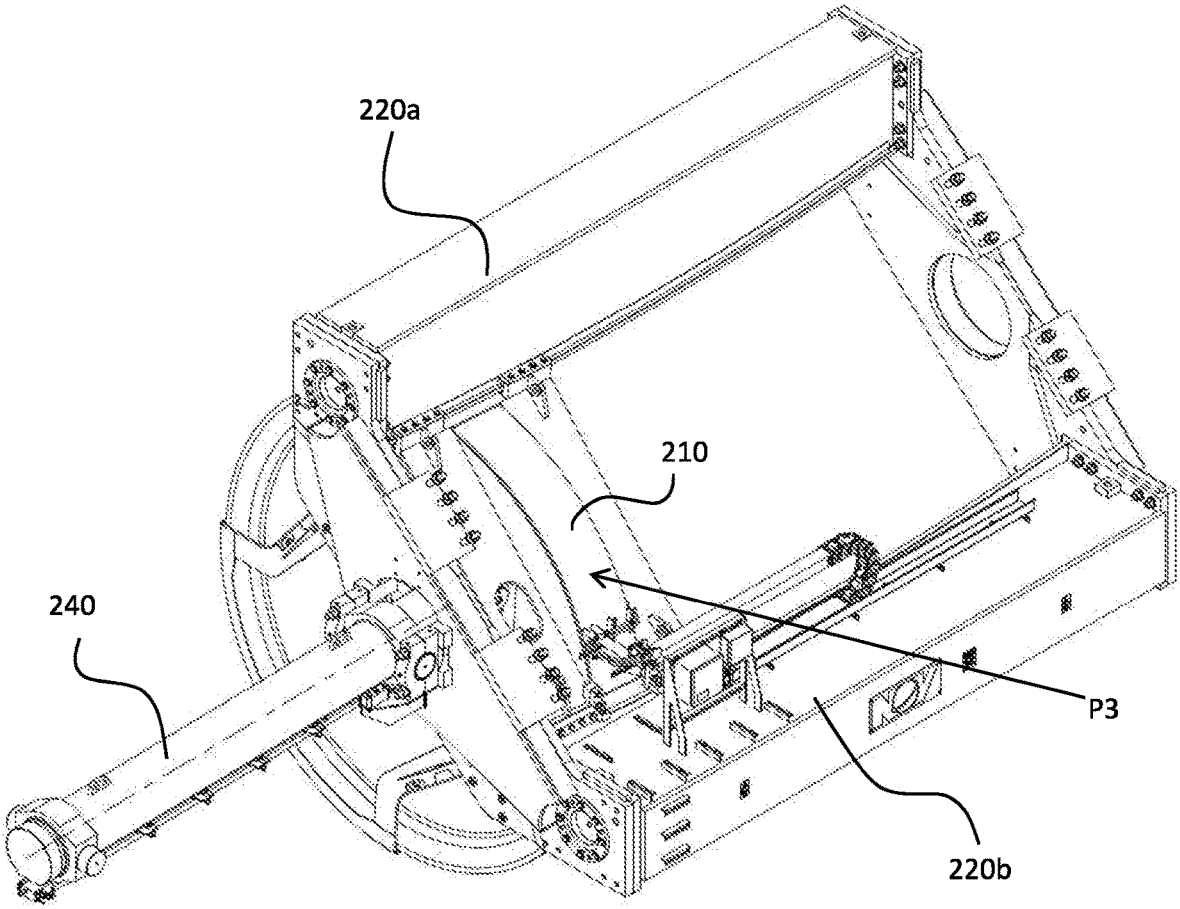
FIG. 8 illustrates the spooling device of FIG. 2 in a first extreme position.
Figure 9:
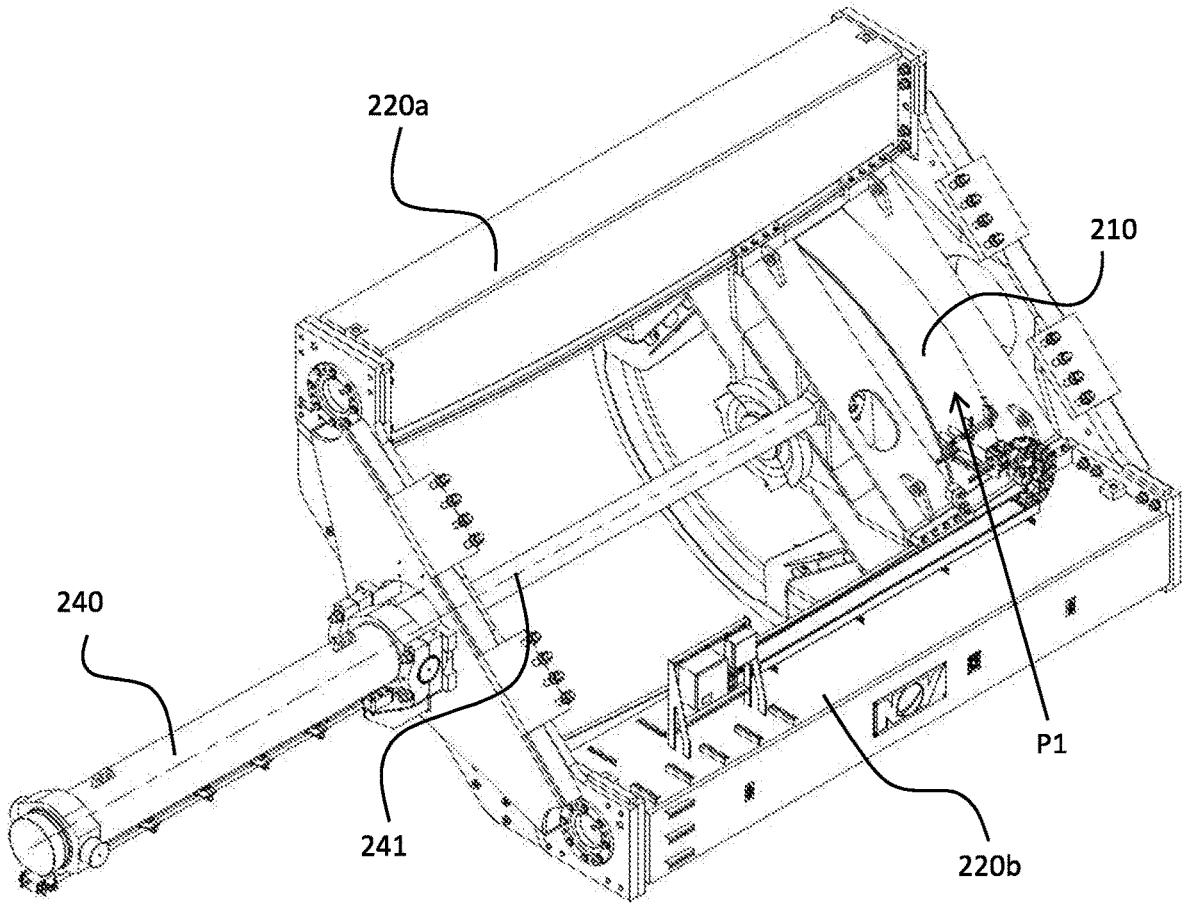
FIG. 9 illustrates the spooling device of FIG. 2 in a second extreme position.

FIG. 7 illustrates the spooling device of FIG. 2 in a center position P2. FIG. 8 illustrates the spooling device of FIG. 2 in the second extreme position P3. The hydraulic cylinder 240 is fully retracted in this position. FIG. 9 illustrates the spooling device of FIG. 2 in the first extreme position P1. The hydraulic cylinder 240 is fully stroked in this position. All the relevant parts have been discussed in respect of the other figures.

In the description of the figures, it has been illustrated how the suspension cradle 210 with the wire sheave 215 is driven parallel to the drum winch rotation axle by the powered drive mechanism (i.e. hydraulic cylinder) 240. To avoid any undesired wire rope fleet angle, the suspension cradle 210 is arranged to move in a pendulum with the crane king sheave 150 as the center. Because of this arrangement, the wire sheave 215 is not subjected to any side forces. Furthermore, because of the fact that the wire 99 is kept in-line with the wire sheave 215 the wire (typically made of steel) lifetime is increased. The powered drive mechanism 240 is preferably located in line with the center of the thrust beams 220*a*, 220*b* in order to avoid tilting forces on the suspension cradle 210.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The mere fact that certain measures are recited in mutually different dependent claims does not indicate that a combination of these measures cannot be used to advantage. In the device claim enumerating several means, several of these means may be embodied by one and the same item of hardware.

The invention claimed is:

1. Spooling device for facilitating spooling of a wire on a drum winch from a feeding point (fp), the spooling device comprising:

a frame, and a suspension cradle mounted to the frame, wherein the suspension cradle comprises a rotatable wire sheave for receiving the wire and for guiding the wire to a specific location on the drum winch, wherein the suspension cradle with the wire sheave is mounted in a slideable manner to the frame in accordance with a curved path (cp), wherein the curved path (cp) is chosen such that a fleet angle (fa) of the wire coming from the feeding point (fp) is at least partially compensated in order to reduce fringing effects of the wire on the wire sheave during sliding movement of the wire sheave in operational use of the spooling device.

2. The spooling device according to claim 1, wherein the curved path (cp) is defined such that the fleet angle (fa) is substantially compensated along the full swing of the wire sheave in that the wire remains substantially in plane with the wire sheave during the sliding movement of the wire sheave in operational use of the spooling device.

3. The spooling device according to claim 2, wherein the curved path (cp) is, along a full swing of the wire sheave, a substantially circular path having its center coinciding with the feeding point (fp) in operational use of the spooling device.

4. The spooling device according to claim 3, wherein the suspension cradle is mounted to the frame via a first thrust beam, wherein the first thrust beam comprises a curved rail (220*a*1) onto which the suspension cradle is mounted in the slideable manner.

5. The spooling device according to claim 4, wherein the suspension cradle is further mounted to the frame via a second thrust beam displaced from the first thrust beam, wherein the second thrust beam comprises a second curved rail onto which the suspension cradle is mounted in the slideable manner.

6. The spooling device according to claim 4, further comprising a powered drive mechanism mounted to the frame, the powered drive mechanism being coupled to the suspension cradle for actuating the suspension cradle for controlling a position of the suspension cradle on said rail (220*a*1, 220*b*1).

7. Crane assembly comprising a crane and a spooling device in accordance with claim 1, wherein the spooling device is placed between the crane and the drum winch for facilitating the spooling of the wire on the drum winch.

8. Vessel comprising the crane assembly in accordance with claim 7.

9. The vessel according to claim 8, wherein the crane is placed on a deck of the vessel, wherein the drum winch is placed under the deck, and wherein the spooling device is placed under the deck.

10. A system for spooling a wire where the wire extends from a feed point, the system comprising:

a support surface;

a drum winch mounted to the support surface;

a sheave supported at a height above the support surface and defining the feed point for the wire;

a spooling device mounted to the support surface and spaced apart from the drum winch and from the feed point, the spooling device comprising:

a frame;

a suspension cradle mounted to the frame via at least a first thrust beam that includes a curved rail, wherein the suspension cradle comprises a rotatable wire sheave for receiving the wire extending from the feed point and for guiding the wire to a specific location on the drum winch, wherein the suspension cradle with the wire sheave is mounted in a slideable manner to the frame in accordance with a curved path that is configured such that a fleet angle of the wire coming from the feeding point is at least partially compensated in order to reduce fringing effects of the wire on the rotatable wire sheave during sliding movement of the wire sheave along the frame.

11. The system of claim 10 wherein the curved path is, along a full swing of the wire sheave, a substantially circular path having its center coinciding with the feeding point.

12. The system of claim 10 further comprising a powered drive mechanism mounted to the frame, the powered drive mechanism being coupled to the suspension cradle and configured for actuating the suspension cradle to move along the rail.

13. The system according to claim 12, wherein the curved path is configured such that, during the sliding movement of the wire sheave along the full swing of the wire sheave along the rail, the wire remains substantially in plane with the wire sheave.

14. The system of claim 13 wherein the curved path is, along a full swing of the wire sheave, a substantially circular path having its center coinciding with the feeding point.

15. The system of claim 10 wherein the drum winch is supported below the support surface.

16. The system of claim 15 wherein the spooling device is supported below the support surface.

17. The system of claim 16 further comprising a crane mounted to the support surface and supporting the sheave above the support surface.

18. Spooling device for facilitating spooling of a wire on a drum winch from a feeding point (fp), the spooling device comprising:

a frame, and a suspension cradle mounted to the frame, wherein the suspension cradle comprises a rotatable wire sheave for receiving the wire and for guiding the wire to a specific location on the drum winch, wherein the suspension cradle with the wire sheave is mounted in a slideable manner to the frame in accordance with a curved path (cp), wherein the curved path (cp) is chosen such that a fleet angle (fa) of the wire coming from the feeding point (fp) is compensated in order to reduce fringing effects of the wire on the wire sheave during sliding movement of the wire sheave in operational use of the spooling device;

wherein the curved path (cp) is defined such that the fleet angle (fa) is substantially compensated along the full swing of the wire sheave in that the wire remains substantially in plane with the wire sheave during the sliding movement of the wire sheave in operational use of the spooling device; and wherein the curved path (cp) is, along a full swing of the wire sheave, a substantially circular path having its center coinciding with the feeding point (fp) in operational use of the spooling device; and wherein the wire crosses the curved path (cp) perpendicularly independent of the fleet angle (fa).

* * * * *